United States Patent [19]

Martin

[11] Patent Number: 4,467,733

[45] Date of Patent: Aug. 28, 1984

[54] DEVICE FOR WORKING THE HEM OF TUBULAR PIECES OF GARMENT

[75] Inventor: Alfred Martin, Rheinstetten-Forcheim, Fed. Rep. of Germany

[73] Assignee: Pfaff Industriemaschinen GmbH, Fed. Rep. of Germany

[21] Appl. No.: 570,520

[22] Filed: Jan. 13, 1984

[30] Foreign Application Priority Data

Jan. 26, 1983 [DE] Fed. Rep. of Germany ... 8302034[U]

[51] Int. Cl.[3] ..... D05B 23/00

[52] U.S. Cl. ..... 112/2; 112/63; 112/276

[58] Field of Search ..... 112/63, 2, 121.24, 121.26, 112/121.29, 276, 10, 11

[56] References Cited

U.S. PATENT DOCUMENTS

| | | | |
|---|---|---|---|
| 3,783,805 | 1/1974 | Guichard | 112/2 |
| 3,865,058 | 2/1975 | Rovin et al. | 112/10 X |
| 4,098,201 | 7/1978 | Adamski, Jr. et al. | 112/2 |

FOREIGN PATENT DOCUMENTS

| | | | |
|---|---|---|---|
| 748893 | 9/1970 | Belgium | 112/276 |
| 2216373 | 11/1972 | Fed. Rep. of Germany | 112/2 |

*Primary Examiner*—H. Hampton Hunter

*Attorney, Agent, or Firm*—McGlew and Tuttle

[57] ABSTRACT

A device for sewing tubular material workpieces comprises a sewing machine mounted in a fixed location adjacent a workpiece holder which, for example is shaped to hold a cylindrical workpiece such as a skirt. The holder is engageable in a rotation drive which rotates the holder at a selected speed. A first setting device is connected to the holder so as to move it upwardly and downwardly in respect to the sewing machine. A second setting device is connected to the first setting device and moves it together with the holder toward and away from the sewing machine as desired. The construction includes a pedal control for regulating the speed of rotation of the workpiece and also the operational speed of the sewing machine.

9 Claims, 5 Drawing Figures

FIG.3
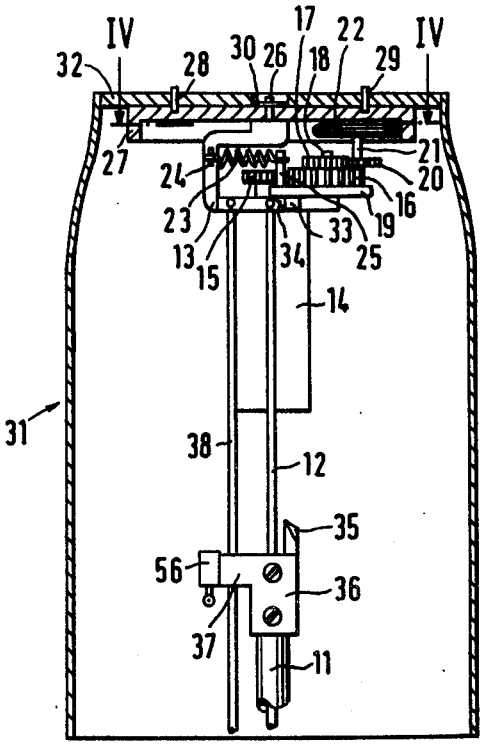
FIG.4
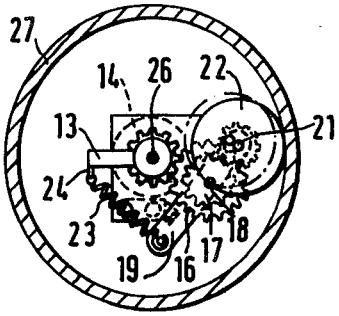
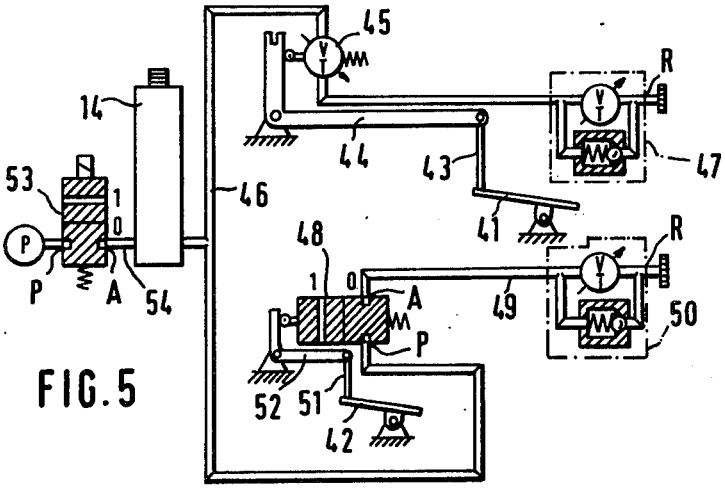
FIG.5

DEVICE FOR WORKING THE HEM OF TUBULAR PIECES OF GARMENT

FIELD AND BACKGROUND OF THE INVENTION

This invention relates in general to sewing machines and in particular to a new and useful device for sewing tubular material workpieces in a sewing machine.

From German OS No. 22 16 373, there is known a device including a rotatable dress form for slipping thereon pieces of garment to be worked. The axis of rotation of the dress form extends through the opening of the piece of garment whose circumferential hem is to be worked. The device comprises a fixed base and a movable frame on which a projecting arm carrying a sewing machine is pivotally mounted. As a basic construction, a drive shaft and a surrounding hollow shaft are mounted coaxially of the axis of rotation of the dress form. To bring the dress form and the sewing machine mounted on the pivotal arm into mutual positions for producing a seam corresponding to the circumference of the garment opening, and to keep them in these positions, a plurality of cams is provided which are secured to the drive shaft and the hollow shaft and control the movements of the mobile frame, of the arm with the sewing machine, and of the dress form which is driven at a selected constant circumferential speed for the hem to be sewed. Two of the control cams are conformable to the circumferential shape of the garment hem and they determine the extension of the seam.

The drawbacks of this prior art design are the necessity for expensive control means and, particularly, the fact that only a definite range of garment sizes can be worked with one set of the control cams, while the device must be re-equipped in a time consuming manner with other control cams for working other sizes of garment. It is further unsatisfactory that with the use of a set of control cams for several sizes of garment, stitches of different lengths are produced in each size because for a single revolution of the dress form, the lengths of the seams are different, depending on the size of the garment. Further, since the circumferential length of the hem to be worked also depends on the cut of the garment, the device requires a still more frequent re-equipment. Anyway, the dress form must be changed frequently. Finally, in this design, the necessity of keeping in stock numerous control cams is expensive in itself.

SUMMARY OF THE INVENTION

The invention is directed to a substantial simplification of a sewing device such that it can be employed for working tubular pieces of garment of any commercial size and cut, without requiring a re-equipment.

In accordance with the invention, a device for sewing tubular material workpieces includes a sewing machine disposed adjacent a workpiece holder which is engageable with a rotation device for rotating the holder at a selected speed. The first setting device is connected to the rotation means and it may shift it backwardly and forwardly in respect to the sewing machine along a first directional path. The second setting device is connected to the first setting device shifting the second setting device backwardly and forwardly relative to the sewing machine along a second path which is disposed at an angle to the first path. The rotational speed is controlled by a pedal control circuit along with the separate pedal control circuit for the sewing machine speed. In addition, these controls may effect the shifting of the setting means as desired.

With the invention it is possible to move the hem to be worked of pieces of garment such as skirts through the stitch forming area of the sewing machine while the garment is held in a position of later use. The garment may also be cut into correct lengths and finished with trimming. This makes it possible to eliminate the preliminary marking which might otherwise be required. The advance speed is adjusted to the sewing machine speed and may be corrected by the operator independently of the sewing speed.

In accordance with the invention the setting means advantageously comprise air cylinders. One of them is mounted on a support which is shiftable by the other. Sewing machine drives includes a clutch motor and the workpiece is moved in a rotary manner by an air turbine. Both are controllable by a throttle valve which is adjusted by a control lever and the clutch motor. The construction includes a settable throttle valve and a directional valve which is actuatable independently thereof and is also associated with a throttle valve.

Advantageously the rotary drive mechanism comprises an engaging plate which can be coupled to a dress form so as to drive the form in a rotary motion. The drive means includes a rotatable friction disc which is engageable with the shoulder of a dress form to rotate it. The constructions ensures a speedy exchange of the dress form without any difficulty. In the feed position, the drive is disconnected automatically so that while slipping on or removing a piece of garment the dress form is unimpeded and can be rotated easily. Alternatively, the dress form may be moved by an electric motor which is controllable through a switching mechanism which also controls the operation of the sewing machine or which is associated with a second switching mechanism which operates the sewing machine.

Accordingly it is an object of the invention to provide an improved device for sewing annular workpieces.

A further object of the invention is to provide a device for sewing tubular articles such as dresses and the like which are mounted on a form which is rotated and which may be selectively positioned relative to a sewing machine.

A further object of the invention is to provide a device for sewing workpieces which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 3 is an enlarged sectional view of the dress form and the drive thereof,

FIG. 4 is a sectional view taken along the line IV—IV of FIG. 3; and

FIG. 5 is a schematic diagram of the pneumatic circuit of the drive of the dress form.

BRIEF DESCRIPTION OF THE PREFERRED EMBODIMENT

Figure 2:
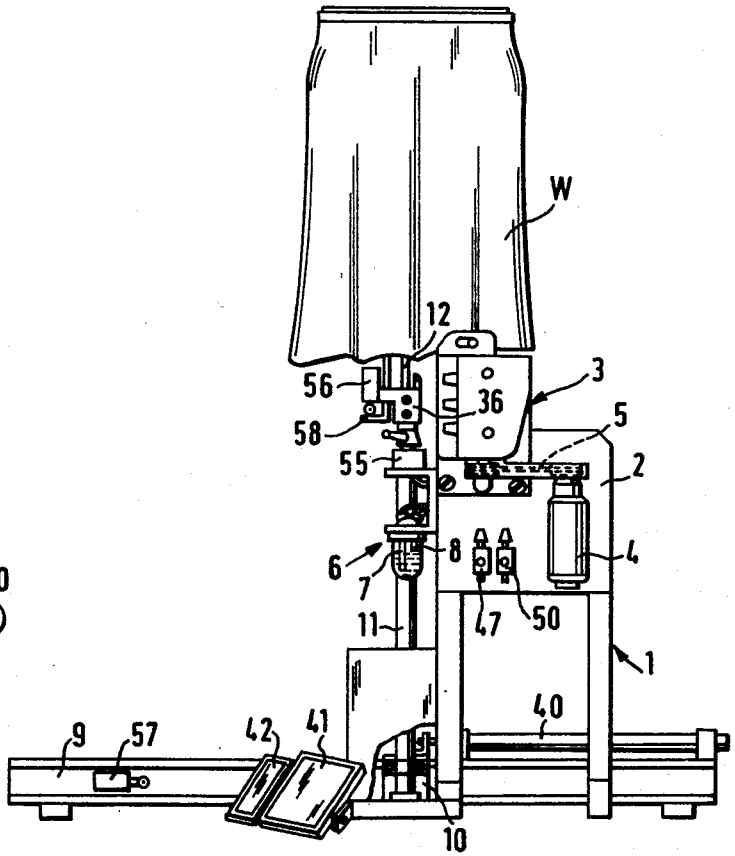
FIG. 2 is a view similar to FIG. 1 showing the dress form in its working position, with a piece of garment slipped thereon.

Referring to the drawings, in particular the invention embodied therein comprises a device for sewing tubular material workpieces using a sewing machine which comprises a workpiece holder 31 which is selectively rotated by rotation means which includes an air turbine 14 which drives a rotatable member 21 which is frictionally engaged with an engaging plate 27 which may engage with a plate 32 of the workpiece holder or form 31. First setting means 11 are engageable with the rotation means to shift the rotation means backwardly and forwardly relative to the sewing machine 3 along a first directional path. Second setting means 40 are connected to the first setting means 11 to shift the second setting means backwardly and forwardly relative to the sewing machine 3 along a second path disposed in an angle to the first path. Control means including foot pedals 41 and 42 are connected between the sewing machine and the rotation means 14 for controlling the speed of the rotation means relative to the speed of the sewing machine.

Figure 1:
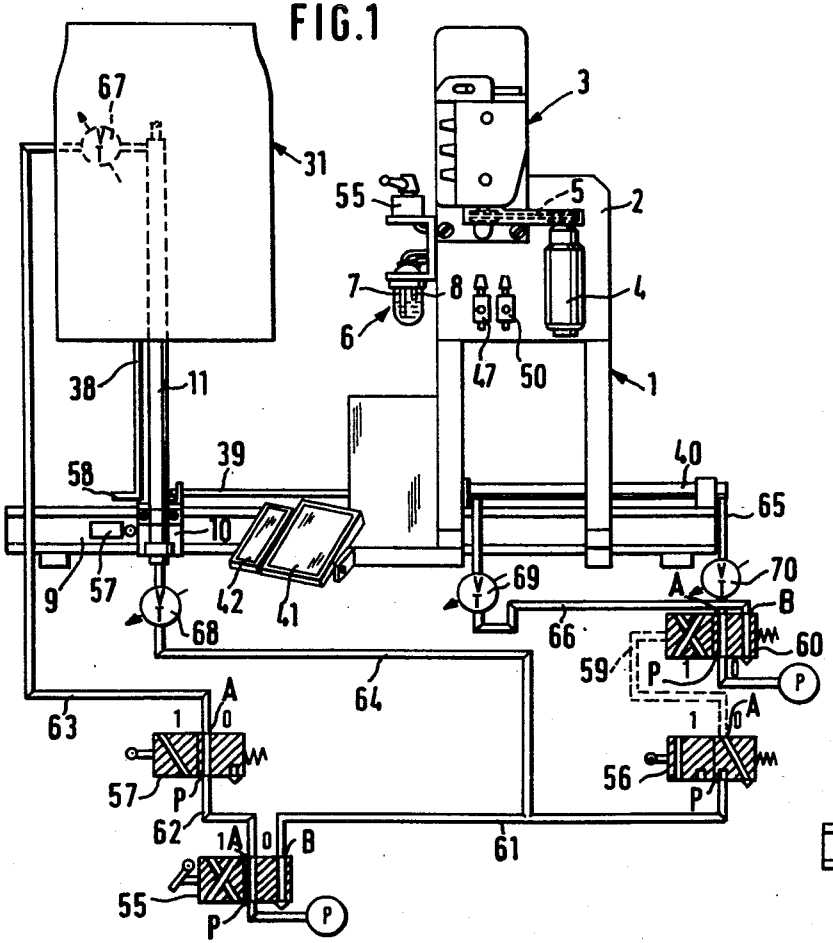
FIG. 1 is an elevational view of a sewing device showing a dress form in its feed position, and with a schematic diagram of the pneumatic circuit of the means for controlling the movement of the dress form.

As shown in FIGS. 1 and 2, the device comprises a frame 1 and, secured thereto, a vertically extending plate 2 for supporting an overcast sewing machine 3 of known design, equipped with an edge trimming mechanism, and a motor 4 driving the sewing machine through a belt 5. Because of its mounting in vertical position, sewing machine 3 is oil-tightly sealed at the side of its hand wheel. The tank 6 for lubricating oil is secured to frame 1 outside the sewing machine and connected to an oil pressure pump (not shown) within the housing of the sewing machine through a forward line 7. During the sewing operation, the lubricating oil is forced by the pump to the lubricating points. During the periods between sewing operations, the oil returns to tank 6 through a return line 8.

Secured to the lower part of frame 1 is a rail 9 for a support 10 of an air cylinder 11 which is intended as a first setting means for a dress form 31. As shown in FIG. 3, a bracket 13 is secured to the upper end of a piston rod 12 of air cylinder 11, by which an air turbine 14, or an electric motor, is supported. At the driven side of the turbine 14, a pinion 15 is mounted meshing with a gear 16 which is mounted for rotation on a journal pin 18 secured to bracket 13. Further mounted for rotation on a journal pin 18 are another gear 17 which is non-rotatably connected to gear 16, and a two-armed lever 19. Gear 17 meshes with a gear 20 which is secured to a shaft 21 mounted on lever 19 and carrying a friction wheel 22 on its free end. By means of a tension spring 23 attached to an eye 24 of bracket 13 and by its other end to a pin 25 carried on lever 19, friction wheel 22 is held in frictional drive contact with a cylindrical engaging plate 27 which is rotatable about a pin 26 projecting from bracket 13. Plate 27 carries two drive pins 28,29 and is secured against axial displacement by a guard ring 30. A dress form 31 having a plate 32 secured in its upper opening can be placed on engaging plate 27. Plate 32 has bores for driver pins 28 and 29. On the underside of lever 19, a cam surface 33 is provided which cooperates with an opposite surface 35 of a guide piece 36 provided on the upper end of the housing of air cylinder 11, to pivot lever 19 from it position shown in FIG. 3 and corresponding to the feed position of dress form 31, against the action of the spring 23, and thus disengage friction wheel 22 from engaging plate 27 as shown in dash-dotted lines in FIG. 4.

Guide piece 36 includes a forked guide portion 37 for a guide rod 38 which is secured to the bracket 13 and is intended for ensuring a straight movement of bracket 13 and the securing of the bracket against rotation during the motion of piston rod 12.

To displace air cylinder 11 along with the dress form 31 and the associated drive mechanism transversely, support 10 of air cylinder 11 is connected to the horizontally displaceable piston rod 39 of an air cylinder 40 which is secured to frame 1 and operates as the second setting means of dress form 31.

Frame 1 supports two pedals 41,42 for actuating the clutch of the drive motor 4 and for controlling the rotary speed of the dress form 31. Pedal 41 is connected to clutch lever 44 of the motor through a linkage 43 shown in a simplified manner. Upon actuating pedal 41, lever 44 displaces the coupling disc of motor 4 and at the same time controls a throttle valve 45 which is mounted in the exhaust line 46 of air turbine 14 and is followed by a manually settable throttle valve 47.

Pedal 42 is to actuate a directional valve 48 having its connection B applied to the exhaust line 46 of air turbine 14 and its connection A leading through a line 49 to a manually settable throttle valve 50. A linkage 51 in simplified showing connects pedal 42 to an angle lever 52 actuating directional valve 48.

The control mechanism further comprises a solenoid valve 53 having its connection A connected through a line 54 to the inlet side of air turbine 14, a manually switchable 4/2 directional valve 55, and to limit switch valves 56,57 of which one 56 is provided on guide piece 36 and is actuable through a bent portion 58 of the lower end of guide rod 38, while the other valve 57 is provided on rail 9 and is actuable through support 10.

Connection A of limit switch valve 56 is connected through a control line 59 to a reversing valve 60 responsive to pressure, while connection B of limit switch valve 56 is connected through a line 61 to connection B of directional valve 55. Connection A of valve 55 is connected through a line 62 to connection B of limit switch valve 57. Connection A of valve 57 leads through a line 63 to the upper end of air cylinder 11 whose other end is connected through a line 64 to line 61. Connection A of reversing valve 60 is connected through a line 65 to one of the ends of air cylinder 40 and through a line 66 to the other end thereof. To reduce the speed of the pistons or piston rods 12, 39 of air cylinders 11 and 40, adjustable exhaust throttles 67 to 70 are provided in lines 63 to 66.

The device operates as follows:

In the feed position shown in FIG. 1 of the dress form 31 placed on engaging plate 27, a piece of garment W in its arrangement of later use is slipped on the dress form which is separated from its rotary drive (14 to 26) by the outer engagement of cam surfaces 33 and 35, and thus is freely rotatable, and is brought into a position provided for starting the sewing operation. Upon switching on the main electrical switch (not shown) of the device, motor 4 is switched on in idle run and solenoid valve 53 is switched at the same time and put into its position 1, so that compressed air is applied through inlet A and line 54 to the inlet side of air turbine 14.

Directional valve 55 is then switched into position 1, so that air cylinder 11 is vented through exhaust throttle 67, line 63, connections A and B of limit switch valve 57, line 62, connection A, and vent connection of valve 55 and is supplied with compressed air through pump connection B and connection A of valve 55, lines 61 and 64. This moves piston rod 12 with dress form 31 upwardly. As soon as cam 33 is disengaged from surface 35, FIG. 3, friction wheel 22 is brought by tension spring 23 into frictional contact with engaging plate 27. In the end position of piston rod 12, limit switch valve 56 is actuated by the bent portion 58 of guide rod 39 and switched into position 1.

Reversing valve 60 is then supplied with compressed air through connection A of limit switch valve 56 and control line 5 and pushed into switching position 1 in which the right-hand side of air cylinder 40 (FIG. 1) is vented through line 65, exhaust throttle 70, connection A, and the exhaust connection of reversing valve 60, and the left-hand side of air cylinder 40 is supplied with compressed air through connection B of reversing valve 60 and line 66, so that the dress form 31 with the garment W is moved by piston rod 39 of air cylinder 40 into the working position shown in FIG. 2, and the lower hem of the workpiece W is brought into the sewing position at the sewing machine 3.

Then, sewing machine 3 is started by stepping on pedal 41 actuating clutch lever 44 of motor 4. The sewing speed depends on the position of pedal 41. By actuating pedal 41, the hitherto closed throttle valve 45 is adjusted through clutch lever 44 at the same time, to an extent corresponding to the extent of actuation of pedal 41. By setting in advance throttle valve 47 which is done with throttle valve 45 entirely open, the sewing speed and the speed of air turbine 14 driving dress form 31 can be limited to a maximum.

In addition, by actuating pedal 42, the speed of air turbine 14 may be increased independently of the drive of the sewing machine. The maximum possible speed of the turbine is adjusted on throttle valve 50, with directional valve 48 open. If now during the sewing operation in which the hem of the piece of garment W is trimmed and secured with overcast stitches, a higher speed of dress form 31 is needed which depends on the cut and shape of the skirt, directional valve 48 is switched into its position 1 by actuating pedal 42. A larger amount of exhaust air from turbine 14 can then flow into lines 46, 49 and throttle valve 50, than into the branch of exhaust line 46 including throttle valves 45, 47, so that the speed of dress form 31 driven through transmission 15 to 27 can be increased, if needed.

At the end of the seam, the sewing machine is stopped, as is known, in the uppermost position of the needle. The threads are cut, and the presser foot is lifted. Then, directional valve 55 is switched into its zero position, whereupon reversing switch 60 is returned by spring force into the zero position in which air cylinder 40 is vented through exhaust valve 69, connection B, and the venting line of reversing valve 60 and supplied with compressed air through connections B and A thereof and through line 65. The speed with which piston rod 39 then displaces air cylinder 11, support 10, and dress form 31 into the initial position in which support 10 actuates limit switch valve 57 can be adjusted through exhaust valve 69.

Simultaneously with the switching of the valve 55 into the zero position, air cylinder 11 is vented through exhaust valve 68, lines 64, 61 connection B, and the venting connection of directional valve 55, and supplied with compressed air through connections B and A thereof, line 62, connections B and A of limit switch valve 57 and line 63, so that piston rod 12 moves dress form 31 downwardly into the feed position according to FIG. 1. The speed of the downward movement can be adjusted through exhaust throttle 68.

In the final phase of the downward movement of piston rod 12, oblique surface 54 of cam 53 butts against oblique surface 35 of guidepiece 36, whereby lever 19 is pivoted against the action of tension spring 23 and friction wheel 22 is disengaged from engaging plate 27. After removing the worked piece of garment W from dress form 31, the described cycle may start again, for the next piece of garment.

It will be understood that dress forms for pieces of garment of various shape and size may be placed on engaging plate 27. This ensures a relatively wide range of application of the device, covering even dress forms furnished by the customer.

While a specific embodiment of the invention has been shown and described in detail to illustrate the application of the principles of the invention, it will be understood that the invention may be embodied otherwise without departing from such principles.

What is claimed is:

1. A device for sewing tubular workpieces with a sewing machine, comprising a workpiece holder, rotation means engageable with said workpiece holder to rotate said holder, first setting means engageable with said rotation means to shift said rotation means with said workpiece holder backwardly and forwardly relative to the sewing machine along a first directional path, and second setting means connected to said first setting means to shift said second setting means backwardly and forwardly relative to the sewing machine along a second path disposed at an angle to said first path.

2. A device according to claim 1, wherein the sewing machine axis is parallel to said first setting means directional path, said holder comprising a cylindrical dress form.

3. A device according to claim 1, including drive means connected between said sewing machine and said rotation means for controlling the speed of rotation means relative to the speed of said sewing machine.

4. A device according to claim 3, wherein said first and said second setting means each include an air cylinder, a support on which said first air cylinder is mounted before being displaceable by said second air cylinder.

5. A device according to claim 3, wherein said drive means includes a clutch motor driving the sewing machine, said rotation means including an air turbine, said clutch motor having a control lever, an adjustable throttle valve connected to said air turbine for regulating the speed thereof, said control lever being connected to said throttle valve to control said valve, a settable throttle valve connected to said throttle valve, a directional valve connected to said settable throttle valve.

6. A device according to claim 1, wherein said rotation means comprises an engaging plate, said holder including a cylindrical form and means for coupling said dress form to said engaging plate.

7. A device according to claim 6, including an air turbine having a rotatable shaft, means for engaging and disengaging said shaft from said dress form.

8. A device according to claim 7, wherein said means for engaging and disengaging said air turbine to said dress form comprises a friction wheel, an arm being pivotally mounted and adjacent said engaging plate and carrying said wheel and being pivotal between a feed position in which said friction wheel engages said engaging plate, spring means biasing said arm out of engagement with said plate, cam means driven by said drive for moving said arm against said spring means to engage said friction wheel with the dress form.

9. A device according to claim 3, wherein said drive meas comprises an electric motor driving said holder, driving said holder, a first switching mechanism controlling said electric motor and the sewing machine and a second switching mechanism connected to said motor to drive it independentally of the sewing machine.

* * * * *